US012345110B2

(12) United States Patent
Lo et al.

(10) Patent No.: US 12,345,110 B2
(45) Date of Patent: Jul. 1, 2025

(54) METHODS AND SYSTEMS FOR PUMP DOWN RINGS FOR FRAC PLUGS

(71) Applicant: Vertice Oil Tools Inc., Missouri City, TX (US)

(72) Inventors: Mike Lo, Houston, TX (US); Mohamed Saraya, Sugar Land, TX (US)

(73) Assignee: Vertice Oil Tools Inc., Missouri City, TX (US)

( * ) Notice: Subject to any disclaimer, the term of this patent is extended or adjusted under 35 U.S.C. 154(b) by 0 days.

(21) Appl. No.: 18/738,214

(22) Filed: Jun. 10, 2024

(65) Prior Publication Data

US 2025/0012158 A1 Jan. 9, 2025

Related U.S. Application Data

(60) Provisional application No. 63/524,754, filed on Jul. 3, 2023.

(51) Int. Cl.
*E21B 23/10* (2006.01)
*E21B 33/12* (2006.01)

(52) U.S. Cl.
CPC ..... *E21B 23/10* (2013.01); *E21B 33/12* (2013.01)

(58) Field of Classification Search
CPC ..... E21B 23/10; E21B 33/12; E21B 23/06
See application file for complete search history.

(56) References Cited

U.S. PATENT DOCUMENTS

| | | | | | |
|---|---|---|---|---|---|
| 3,002,562 | A * | 10/1961 | Carothers | E21B 23/06 | 166/138 |
| 4,315,543 | A * | 2/1982 | Luers | E21B 33/126 | 277/335 |
| 4,329,916 | A * | 5/1982 | Roeder | E21B 33/126 | 92/240 |
| 7,708,062 | B2 * | 5/2010 | Carro | E21B 33/129 | 166/141 |
| 9,784,066 | B1 * | 10/2017 | Branton | E21B 33/1216 | |
| 10,167,698 | B2 * | 1/2019 | Rosenthal | E21B 33/129 | |
| 10,428,623 | B2 * | 10/2019 | Silva | E21B 41/00 | |
| 10,760,369 | B2 * | 9/2020 | Kao | B33Y 80/00 | |
| 11,492,869 | B2 * | 11/2022 | Urban | E21B 33/1216 | |
| 11,525,343 | B2 * | 12/2022 | Urban | E21B 23/04 | |
| 2017/0314361 | A1 * | 11/2017 | Rosenthal | E21B 33/129 | |
| 2018/0119521 | A1 * | 5/2018 | Silva | E21B 41/00 | |
| 2021/0071500 | A1 * | 3/2021 | Hoffman | E21B 33/16 | |

* cited by examiner

*Primary Examiner* — Steven A MacDonald
(74) *Attorney, Agent, or Firm* — Pierson IP, PLLC

(57) ABSTRACT

A pump down ring is positioned within a cap of a frac plug, wherein the pump down ring includes a fin that is configured to be driven downhole to apply forces directly against the pump down ring to secure the pump down ring within a radial groove within the cap.

21 Claims, 6 Drawing Sheets

PRIOR ART

METHODS AND SYSTEMS FOR PUMP DOWN RINGS FOR FRAC PLUGS

BACKGROUND INFORMATION

Field of the Disclosure

Examples of the present disclosure relate to downhole tools. More specifically, embodiments are linked to a pump down ring positioned within a radial groove within a cap of a downhole tool.

Background

Conventionally, after cementing a well and to achieve Frac/zonal isolation for a Frac operation, a frac plug and perforations on a wireline are pumped downhole to a desired depth. Then, a frac plug is set and perforation guns are fired above to create conduit to frac fluid. This enables the fracing fluid to be pumped. Typically, pumping operations can be used to aid in allowing the assembly of perforation and frac plug to reach the desired depth, specifically in horizontal, deviated, or longer laterals. During a pumping operation, the wireline is pumped downhole with flowing fluid.

Pump down rings are generally positioned on a cap of a frac plug or other downhole tool, and are configured to tow tubulars behind them during the pumping operations. In use, pump down rings have a changeable outer diameter that reduces an annular distance/gap between the inner diameter of the casing and the outer diameter of the downhole tool being run. By increasing the size of the outer diameter of the pump down ring during the pumping operation, the downhole tool can be pumped downhole at faster speeds with less fluid.

However, when utilizing conventional pump-down rings, the pump-down rings attempt to pop out of grooves within the cap. This can cause a seal between the downhole tool and casing, which inhibits the ability of the downhole tool to be pulled upward. In other cases, the pump down ring can end up being pumped below the downhole tool, hence losing the efficacy the pump down ring brings to pumping the downhole tool at higher speeds. Further, conventionally to avoid pop of the pump down ring, the pump down ring can be sandwiched between two threaded pieces with the downhole tool, or, a recess has to be machined in the downhole tool/sub and the pump down ring will have two extra lips that will be contained within the recess.

Accordingly, needs exist for systems and methods utilizing a frac plug with a pump down ring, wherein when fluid flows downhole through an annulus between the frac plug and the inner diameter of the casing a fin flares outward and pins the pump down ring within a radial groove within a cap.

SUMMARY

Embodiments disclosed herein describe systems and methods for a downhole tool, such as a frac plug, with a pump down ring. The pump down ring may include a fin that is configured to flare outward and pin down the pump down ring within a radial groove of a cap by the fin applying pressure against a flange of the fin towards a ledge of a cap. Utilizing the fin of the pump down ring to pin down the flange may inhibit the ability of the pump down ring to pop out of the groove. Embodiments of a downhole tool may include lower slips, a cone, a cap, and a pump down ring.

The lower slips may be positioned adjacent to the lower cone and the cap. The lower slips may be a device that is used to grip and hold the frac plug against the casing's internal diameter. The lower slips may be configured to radially expand or break based on the relative movement with the lower cone to grip an inner diameter of the casing.

The cone may be positioned between a packing element and the lower slips. The cone may be configured to slide towards the cap of the frac plug to radially expand the lower slips.

The cap may be positioned on a distal end of the frac plug, downhole from the slips. The cap may include a radial groove extending around the circumference of the cap. The radial groove may extend from the outer diameter of the cap towards the inner diameter of the cap. The groove may include a ledge, base, and tapered surface. In other embodiments, there may be no tapered surface. The ledge may extend axially from the outer diameter of the cap towards the central axis of the downhole tool. The base may extend along an axis parallel to the central axis of the downhole tool, and the tapered surface may gradually increase the thickness of the cap from the base to the proximal end of the cap. In embodiments, the pump down ring may be configured to be positioned within the groove. In other embodiments, the radial groove may be positioned on any part of the downhole tools, including the top, the center, the slips, or the cone.

The pump down ring may be a device that is configured to be positioned within the radial groove of the cap. The pump down ring may have an outer diameter that is substantially equal to the outer diameter of the cap when no pressure is applied to the pump down ring. Responsive to flowing fluid within an annulus positioned between an outer diameter of the cap and the inner diameter of the casing, an outer diameter or portions of the pump down ring may increase in size. This increase in the outer diameter of the pump down ring minimizes the area annular space between the pump down ring and the casing, allowing the pump down ring to pull the downhole tool downhole faster utilizing less fluid. The pump down ring may include a fin, channel, support, notch, and flange.

The fin may be located on the outer surface of the pump down ring, wherein the outer surface of the fin faces the casing and the inner surface of the fin faces the channel. The fin may have a proximal end that is configured to be located adjacent to, but not touching, the tapered surface of the groove. The fin may have a distal end that is located adjacent to the notch. In embodiments, responsive to flowing fluid within an annulus, the proximal end of the fin may flare outward, increasing the outer diameter of the fin. This expansion of the proximal end of the fin may drive the distal end of the fin across the notch, such that the distal end of the fin applies pressure against the flange towards the ledge of the radial groove, wherein the applied pressure may retain the pump down ring within the groove. In embodiments, the fin may be an elastic element, wherein after being deformed due to the pressure differential equalizing the fin may return to its initial shape.

The channel may be an opening within the pump down ring that extends in an axis parallel to a central axis of the tool, wherein the channel extends from the proximal end of the pump down ring towards the distal end of the pump down ring. Additionally, the channel may be radially situated between the fin and the support. In embodiments, a pressure within the channel may be a channel pressure, wherein when fluid flows within the annulus the channel pressure may be greater than the pressure within the annulus adjacent to the outer diameter of the fin. This pressure difference may cause the fin to flair outward and drive the fin downward. In other embodiments, the friction force or the momentum of the fluid flow may cause the fin to flair outward.

The support may be a projection that extends along an axis parallel to the central axis of the downhole tool. The outer surface of the support may be located adjacent to the channel, and the inner surface of the support may be located adjacent to the base of the radial groove. The length of the support may be substantially the same, or slightly less than, the length of the base of the radial groove. This may allow both ends of the support to fit within the groove.

The notch may be a slit, indentation, cut, etc. extending from the outer surface of the pump down ring towards the inner surface of the pump down ring. The notch may be configured to allow a distal end of the fin to apply forces against the flange when the fin is flared outward. Specifically, when the fin flares outward, the distal end of the fin may move downward, zeroing a width across the notch, and apply forces directly against the flange to hold the pump down ring within the groove.

The flange may be located downhole from the notch and the distal end of the fin. The flange may extend in a direction perpendicular to the channel. In embodiments, a distal end of the flange may be glued, bonded, or otherwise coupled to the ledge, which may cause the flange to always be permanently coupled to the ledge. However, in other embodiments, the pump down ring may be configured to not be glued to the ledge. Responsive to flowing fluid in the annulus, a distal end of the fin may move downward, close the notch, and pin down the flange within the groove by applying compressive forces towards the ledge.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described concerning the following figures, wherein reference numerals refer to like parts throughout the various views unless otherwise specified.

Figure 1:
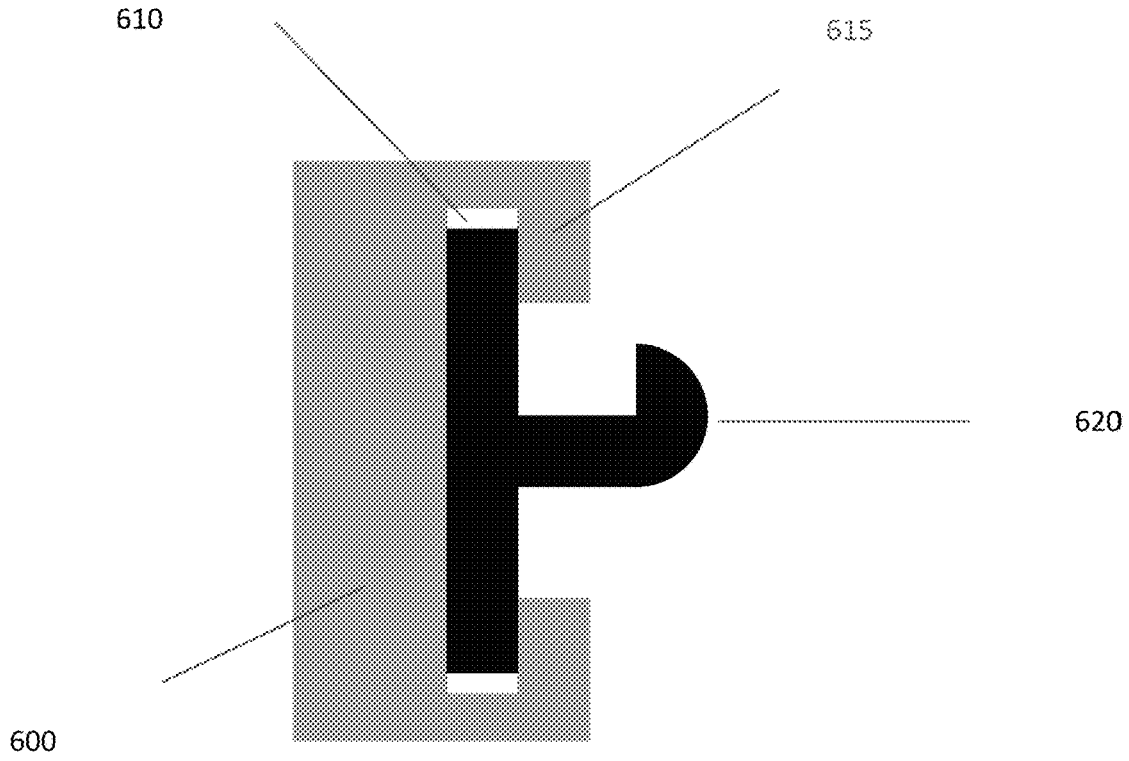
FIG. 1 depicts a prior art version of a downhole tool, according to an embodiment

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted to facilitate a less obstructed view of these various embodiments of the present disclosure.

DETAILED DESCRIPTION

In the following description, numerous specific details are outlined to provide a thorough understanding of the present invention. It will be apparent, however, to one having ordinary skill in the art that the specific detail need not be employed to practice the present invention. In other instances, well-known materials or methods have not been described in detail to avoid obscuring the present invention.

FIG. 1 depicts a prior art version of a downhole tool 600. Conventionally to avoid pop of the pump down ring 620, a recess 610 is machined into the downhole tool 600 or sub with a recess 610 and two extra lips 615 or overhangs. The pump down ring 620 will then need to be positioned within recess 610, having the outer edges of the pump down ring 620 confined by the lips 615.

Figure 2:
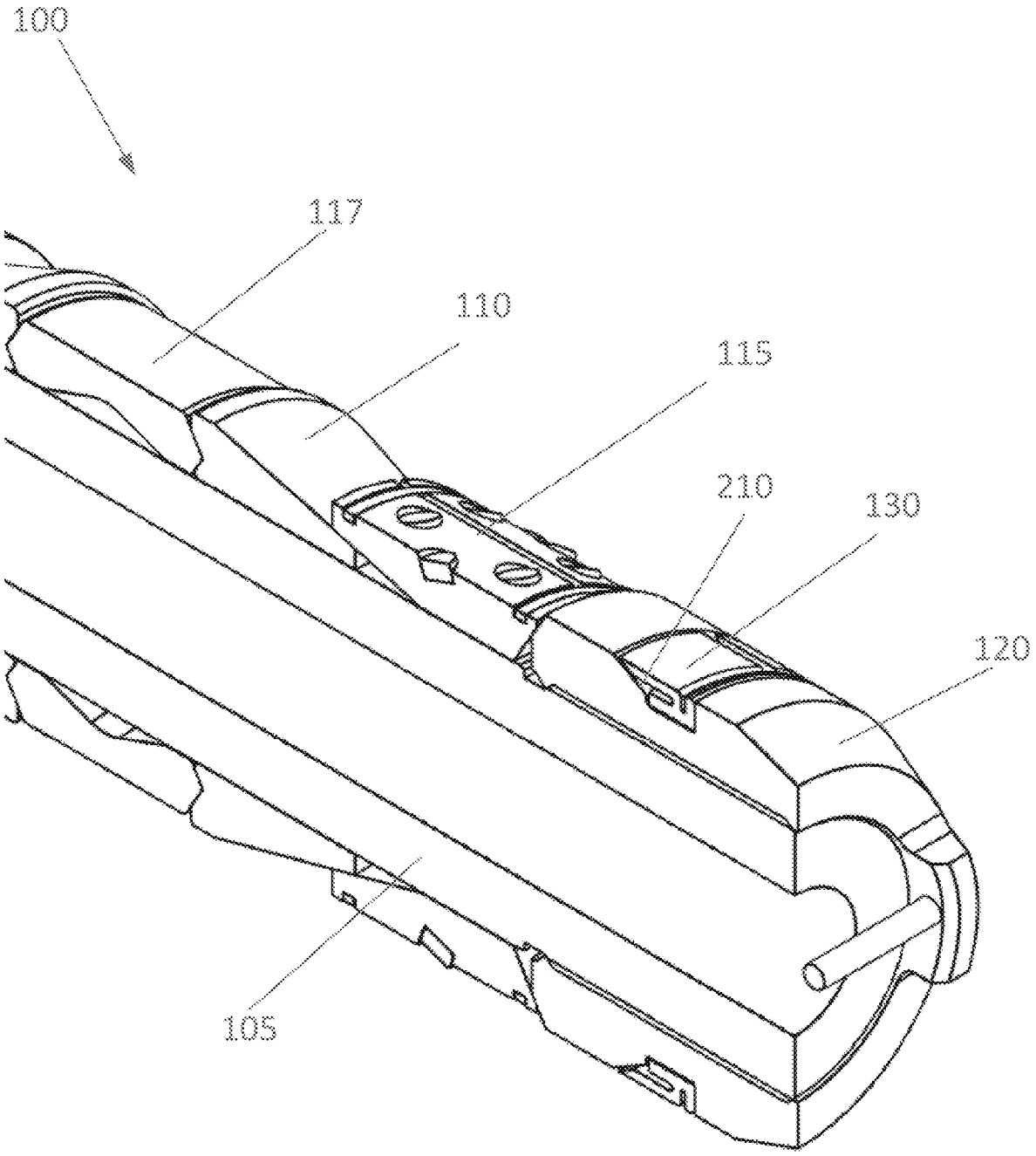
FIG. 2 depicts a cross-section view of a downhole tool, according to an embodiment.

FIG. 2 depicts a cross-section view of the downhole tool 100, according to an embodiment. The downhole tool 100 may be a frac plug, which may be configured to isolate a stage in the casing. Downhole tool 100 may enable perforating and treating each stage optimally and selectively, wherein downhole tool 100 is pumped down to a desired depth, set, and the zone above may be perforated. In embodiments, downhole tool 100 may be a frac plug that is formed of any material, or a combination of materials. The downhole tool 100 may include a mandrel 105, cone 110, packing element 117, slips 115, cap 120, and pump down ring 130. Also, frac plug 100 may be bottom set or top set frac plug.

Cone 110 may be positioned between packing element 117 and slips 115. Cone 110 may be configured to engage with slips 115 to radially expand or break the slips 115.

Packing element 117 may be an elastomeric packing element that is configured to radially expand and seal across the annulus based on a pressure differential.

Slips 115 may be configured to radially move outward and expand across an annulus to secure mandrel 105 to a casing, wherein the annulus is positioned between an outer diameter of mandrel 105 and the casing. Responsive to moving slips 115 across the annulus, slips 115 may grip the inner diameter of the casing. More specifically, slips 115 may be positioned between cone 110 and cap 120. Slips 115 may be configured to radially expand or break responsive to cone 110 moving below slips 115.

Cap 120 may be positioned on a distal end of downhole tool 100. Cap 120 may be positioned adjacent to slips 115, and limit the rotational movement and linear movement of slips 115. Cap 120 may include a passageway that extends through the inner diameter of the cap from a proximal end to a distal end of the cap 120. The passageway may allow fluid to flow through the inner diameter of the frac plug. Cap 120 may also include a radial groove 210 that is configured to receive pump down ring 130.

Groove 210 may extend from an outer circumference of cap 120 towards an inner circumference of cap 120. In embodiments, groove 210 may be directly machined into the outer circumference of cap 120. This may allow cap 120 to be constructed as a single piece, wherein new or existing cap 120 may be retrofitted to receive pump down ring 130.

Groove 210 may be positioned on a frac plug that has a bottom sub, wherein pump down ring 130 can be retrofitted and positioned within the groove 210 without having to remove the bottom sub from the plug mandrel. Additionally, groove 210 may not have any lips or overhangs, which may allow the pump down ring 130 to be inserted within groove 210. The cuts created by machining groove 210 into downhole tool 100 may cause all widths, heights/lengths of groove 210 that are closer to the central axis of the downhole tool 100 to be shorter or substantially equal to the widths of groove 210 positioned further away from the central axis of the downhole tool 100, wherein the width extends along a central axis of the downhole tool 210. This is different than the prior art wherein the overhangs create recesses positioned closer to a central axis of the downhole tool that is longer than the lengths associated with the overhangs positioned further away from the central axis of the downhole tool. The radial groove 210 may be either symmetrical or non-symmetrical.

Pump down ring 130 may be a device that is configured to be positioned within the groove 210. Without outside forces being applied to pump down ring 130, the outer diameter of pump down ring 130 may be substantially equal to the outer diameter of cap 120. In other embodiments, the outer diameter of pump down ring 130 may be smaller than the outer diameter of cap 120. Responsive to flowing fluid within an annulus between the outer diameter of the cap 120 and the inner diameter of the casing, an outer diameter across a proximal end of the pump down ring 130 may increase in size. This increase in the outer diameter of the pump down ring 130 may minimize the annular area between the pump down ring 130 and the casing, allowing the pump down ring 130 to pull the downhole tool 100 downhole faster utilizing less fluid. In other embodiments, the annular area between the pump down ring 130 and the casing may be eliminated when the pump down ring 130 touches the internal diameter of the casing. Furthermore, when pump down ring 130 expands, flowers, or size increases, pump down ring 130 may apply downhole axial forces against groove 210 to secure pump down ring 130 within groove 210.

Figure 3:
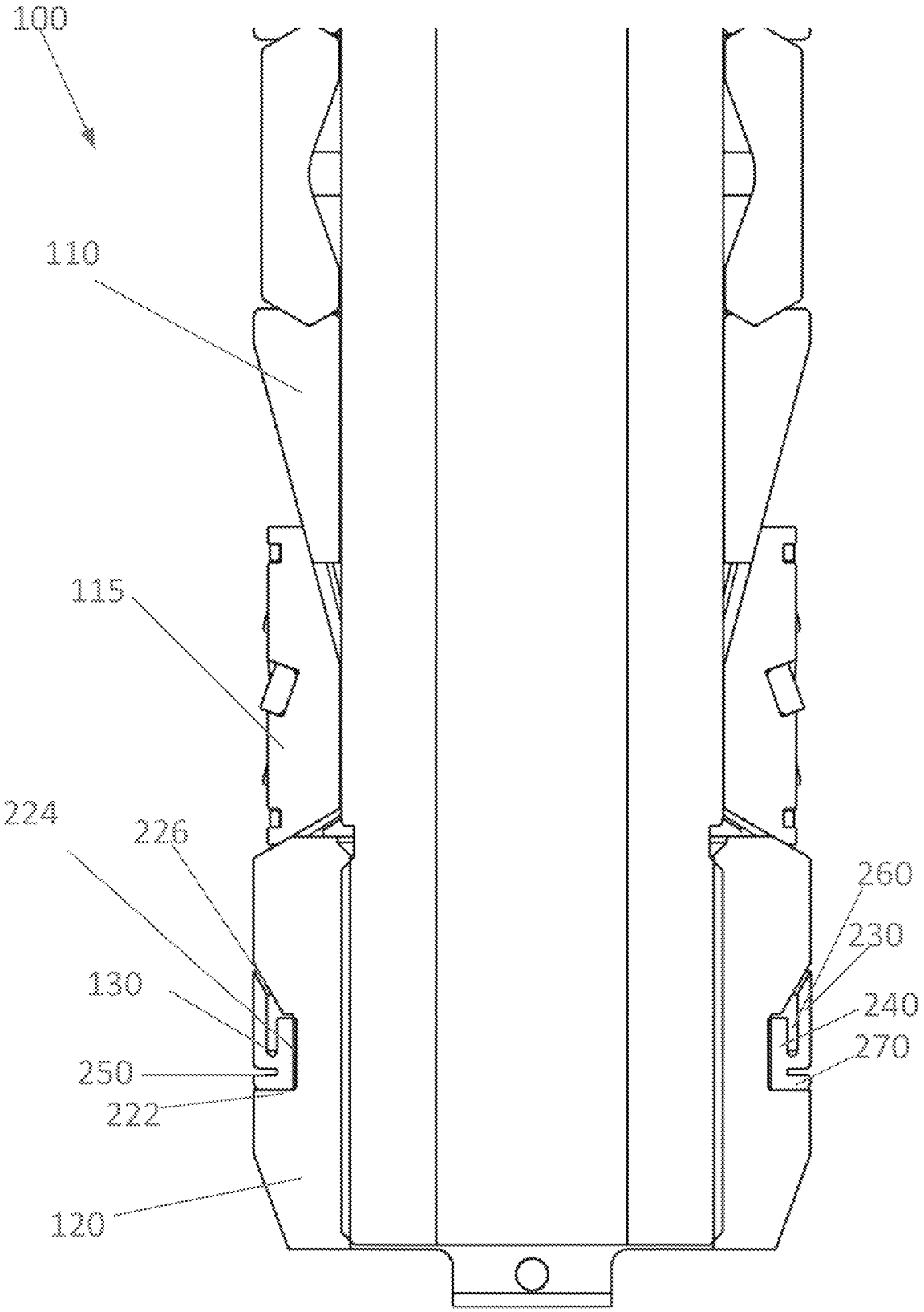
FIG. 3 depicts a cross-sectional view of a downhole tool, according to an embodiment

FIG. 3 depicts a cross-sectional view of tool 100, according to an embodiment. Elements depicted in FIG. 3 may be described above, and for the sake of brevity, a further description of these elements may be omitted. As depicted in FIG. 3, groove 210 may include a ledge 222, base 224, and tapered surface 226. The pump down ring 130 may include a fin 230, channel 260, support 240, notch 270, and flange 250. In other embodiments, tapered surface 226 may be an upper ledge that is not tapered and extends perpendicular to the axial axis of the downhole tool 100 to base 224, wherein a distance between tapered surface 226 and ledge 222 is substantially constant.

Ledge 222 may extend axially from an outer diameter of cap 120 towards a central axis of the downhole tool 100. In embodiments, a length of ledge 222 may define a depth of groove 210. Ledge 222 may be configured to support the pump down ring 130 and flange 230, and to receive forces directly applied by flange 250 of pump down ring 130, which may prevent pump down ring 130 from popping or rolling, while ledge 222 may further assist in securing pump down ring 130 within groove 210.

Base 224 may extend along an axis parallel to the central axis of the downhole tool 100. Base 224 may be configured to be positioned adjacent to an inner surface of support 240 of pump down ring 130, and allow support to slide along base 224. In embodiments, base 224 may be located between ledge 222 and tapered surface 226. In other embodiments, base 224 may not extend along an axis parallel to the central axis of the downhole tool 100.

The tapered surface 226 may gradually increase the thickness of cap 120 from base 122 to the proximal end of cap 130. The tapering of the tapered surface 226 may allow a length of fin 230 to be longer and located further up the hole than other elements of the pump down ring 130. In other embodiments, tapered surface 226 may be an upper ledge that is not tapered and it may be parallel to ledge 222, wherein the upper edge may extend axially away from base 224. This may cause the distance between ledge 222 and the upper ledge to be substantially constant. The substantially constant distance between ledge 222 and an upper ledge may allow for more efficient and easier machining of groove 210 within the outer surface of cap 120.

Pump down ring 130 may be configured to be positioned within groove 210 and secured within groove 210 without any lips or overhangs that secure pump down ring 130 in place. In embodiments, pump down ring 130 may be retained within groove 210 based on axial forces created by pump down ring 130 against groove 130, and not radial mechanical forces by positioning elements over pump down ring 130. Pump down ring 130 may include a fin 230, channel 260, support 240, notch 270, and flange 250.

Fin 230 may be located on an outer surface of the pump down ring 130, wherein an outer surface of fin 230 faces the casing and an inner surface of fin 230 faces the channel 260. Fin 230 may have a proximal end that is configured to be adjacent to, but not touching, tapered surface 226 of the groove 210, and fin 230 may have a distal end that ends at notch 250. Furthermore, a surface area associated with the outer surface of fin 230 may be greater than a surface area associated with the inner surface of fin 230. In embodiments, responsive to flowing fluid within an annulus, the proximal end of fin 230 may flare outward, increasing the outer diameter of fin 230. More specifically, as fluid flows within the annulus outside of fin 230, pressure on the outer surface of the pump down ring 130 may decrease while a pressure within channel 260 remains substantially constant, creating a pressure differential that causes fin 230 to flair outward. This expansion of fin 230 may drive the distal end of fin 230 across notch 270 minimizing a width across notch 270, such that fin 230 directly applies pressure against flange 250 towards the ledge 222. Additionally, the applied pressure downward pressure of fin 230 on flange 250 may retain the pump down ring 130 within the groove 210. In embodiments, fin 230 may be an elastic element, wherein after being deformed due to the pressure differential equalizing fin 230 may return to its initial shape. In other embodiments, fin 230 may have a proximal end that is configured to be positioned adjacent to, and touching, tapered surface 226 of the groove 210 when the proximal end of fin 230 is not radially expanded.

Channel 260 may be an opening within the pump down ring 130. Channel 260 may extend from the proximal end of the pump down ring 130 towards the distal end of the pump down ring 130. Additionally, channel 260 may be located between the fin 230 and the support 240 and tapered surface 226. In embodiments, a pressure within channel 260 may increase when fluid starts flowing within the annulus to a greater value than the pressure within the annulus adjacent to the outer diameter of the fin 230. This pressure difference may cause the fin 230 to flair outward and drive the fin 230 downward. Further, when the fluid starts flowing within the annulus in a direction from the proximal end to the distal end of the pump down ring 130, pressure within channel 260 will increase above pressure in the notch 250.

Support 240 may be a projection that extends along an axis parallel to the central axis of the downhole tool 100. The outer surface of support 240 may be located adjacent to the channel 260, and the inner surface of support 240 may be located adjacent to the base 224. A length of support 240 may be substantially the same, or slightly less than, the length of the base of groove 210. This may allow support 240 and the pump down ring 130 to fit within the groove 210.

Notch 270 may be a slit, indentation, cut, etc. extending from an outer surface of the pump down ring 130 towards support 240. When no forces are applied to pump down ring 130, notch 270 may be orthogonal to channel 260 and may have a first width. When fluid starts flowing within the annulus, the pressure within the annulus adjacent to the outer diameter of fin 230 may be greater than the pressure adjacent to the inner diameter of fin 230. This pressure differential may cause the width across notch 270 to change in size. In embodiments, the first width may decrease in size to the second width.

Responsive to changing the width across notch 270, notch 270 may receive forces from the distal end of fin 230 to apply forces against the flange 250. In other embodiments, when fin 230 flares outward, the distal end of fin 230 may move downward, causing the second width across the notch 270 to be zero, allowing fin 230 to apply forces against the flange 250 to hold the pump down ring 130 within the groove 210.

Flange 250 may be located downhole from notch 270 and the distal end of fin 230. In embodiments, a distal end of flange 250 may be glued, bonded, or otherwise coupled to the ledge 222 Additionally, support 240 may be glued to base 224. However, in other embodiments, the pump down ring 130 may be configured to fit within the groove 210. In embodiments, responsive to flowing fluid in the annulus, a distal end of the fin 230 may move downward, close the notch 270, and pin down the flange 250 within the groove 210 by applying compressive forces towards the ledge 250.

Figure 4:
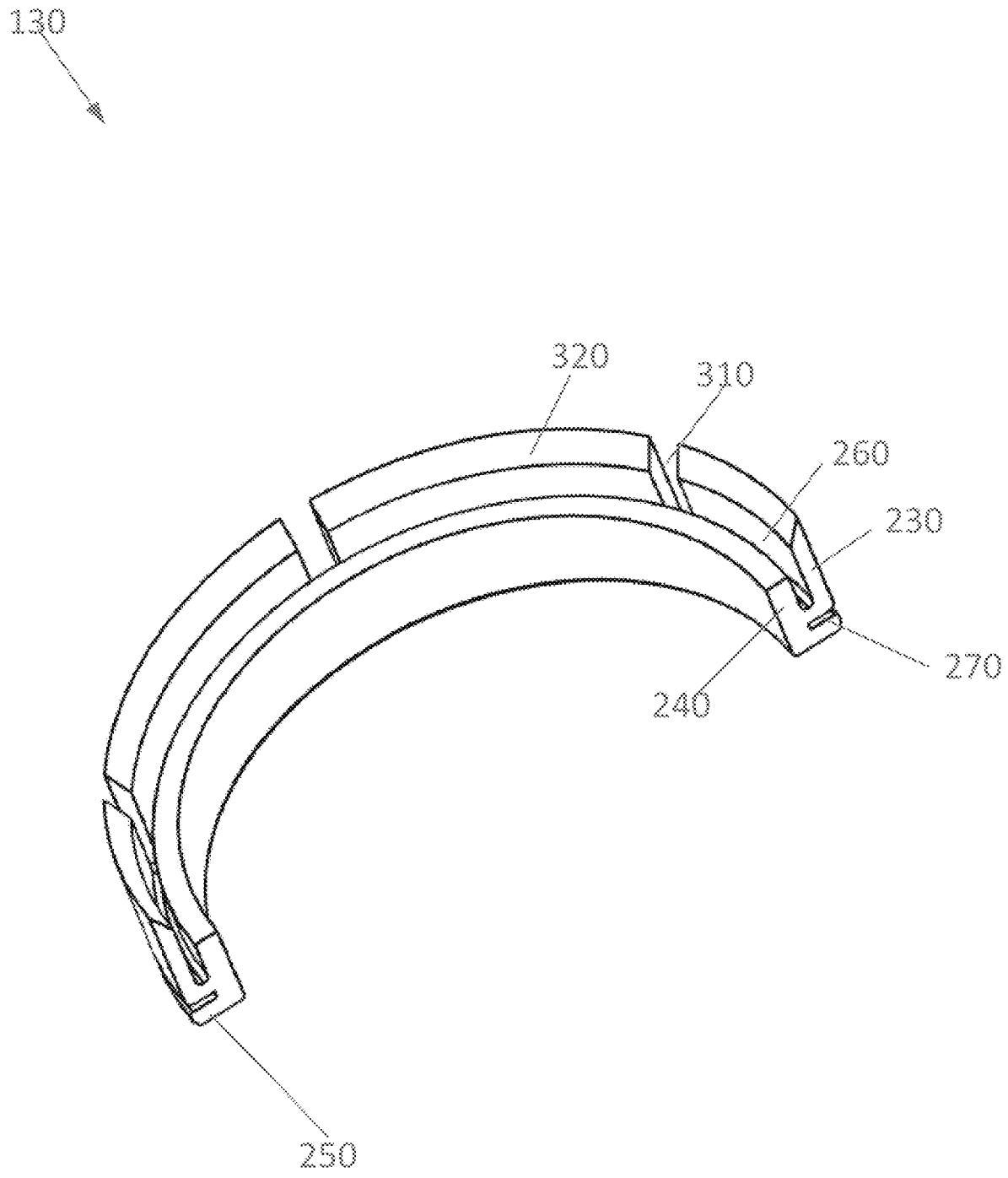
FIG. 4 depicts a cross-sectional view of a pump down ring, according to an embodiment.

FIG. 4 depicts a cross-sectional view of the pump down ring 130, according to an embodiment. Elements depicted in FIG. 4 may be described above, and for the sake of brevity, a further description of these elements may be omitted.

As depicted in FIG. 4, fin 230 may be partitioned into a plurality of fins 230, 310 via slots 310 between the sections of fins 230, 310, while support 240 may be a continuous rim 240. By partitioning fins 230, 310 it may be less likely that the pump down ring 130 becomes stuck downhole by providing a bypass in case the downhole tool 100 needs to be pulled out, this may happen by not allowing fins 230, 310 to form a seal across the annulus. Additionally, partitioning fins 230, 310 allows the pressure within the annulus and the pressure within channel 260 to more quickly equalize once fluid stops flowing.

Figure 5:
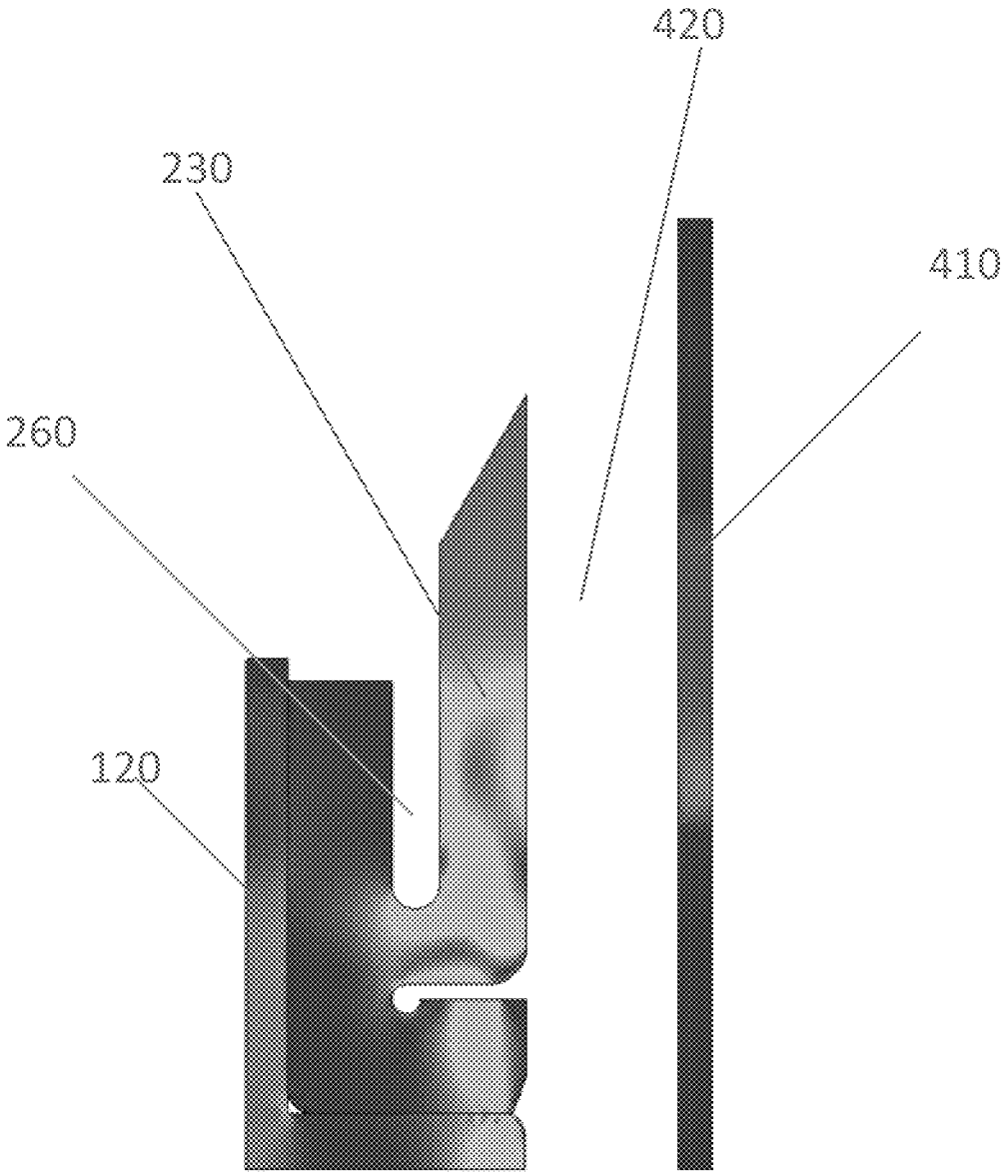
FIG. 5 depicts a cross-sectional view of a downhole tool when fluid is not flowing within an annulus, according to an embodiment.

FIG. 5 depicts a cross-sectional view of downhole tool 100 when fluid is not flowing within annulus 420, according to an embodiment. Elements depicted in FIG. 5 may be described above, and for the sake of brevity, a further description of these elements may be omitted.

As depicted in FIG. 5, when fluid is not flowing within an annulus 420, between casing 410 and fin 230, the pressure within channel 230 may be substantially similar to the annulus pressure. This equalization of pressure may not cause fin 230 to flair outward.

Figure 6:
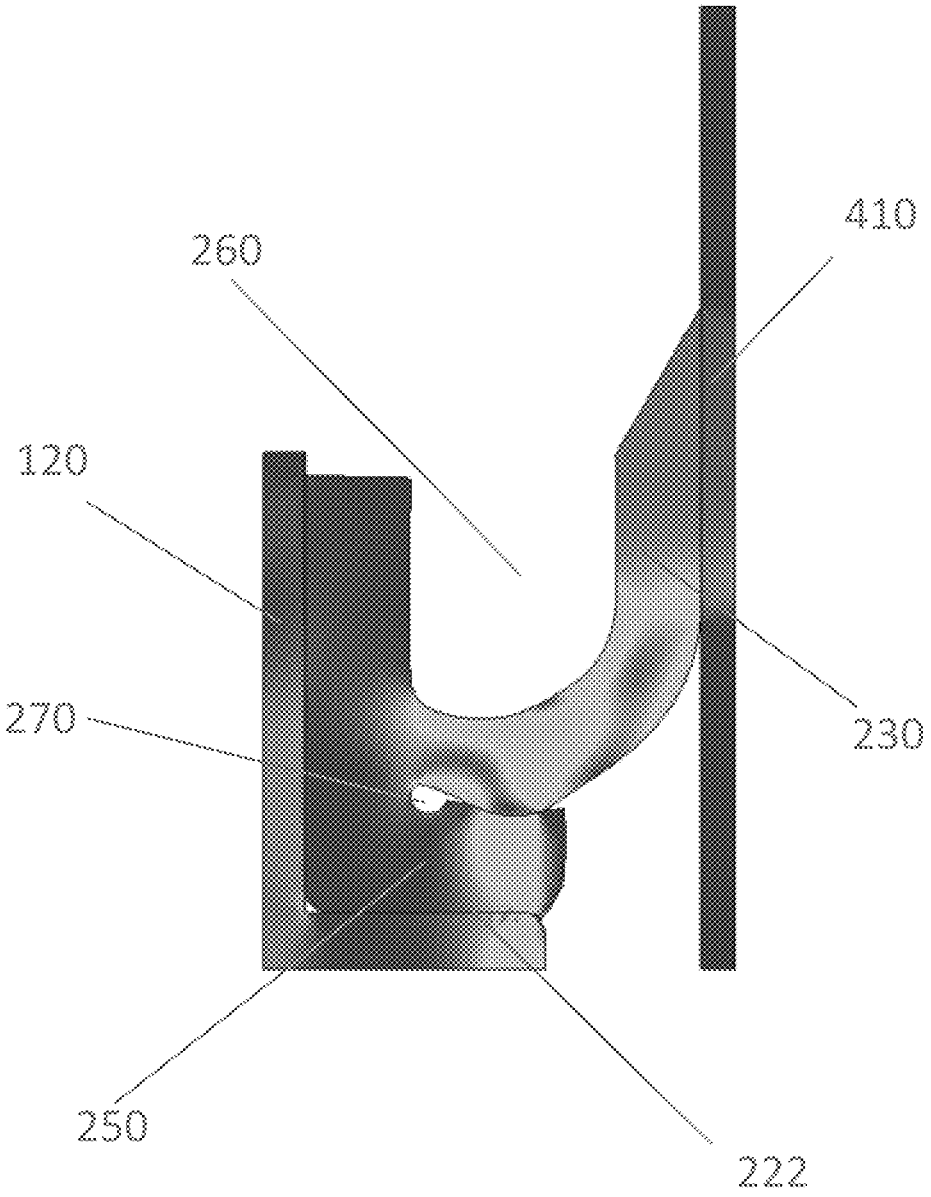
FIG. 6 depicts a cross-sectional view of a downhole tool when fluid is flowing within an annulus, according to an embodiment.

FIG. 6 depicts a cross-sectional view of the downhole tool 100 when fluid is flowing within annulus 420, according to an embodiment. Elements depicted in FIG. 6 may be described above, and for the sake of brevity, a further description of these elements may be omitted.

As fluid flows within annulus 420, the annulus pressure being applied to the outer surface of fin 230 may decrease, causing a pressure differential between the channel 260 pressure and the annulus pressure to increase. This increase in the pressure differential may cause fin 230 to flair outward across the annulus, increasing an exposed surface of the inner surface of fin 230, and allowing fin 230 to be driven downward within groove 210. As fin 230 is driven downward, the distal end of fin 230 may contact and apply pressure against flange 250. Flange 250 may transfer this received pressure to ledge 222 to secure the pump down ring 130 within groove 210.

When fluid ceases to flow through the annulus 420, the pressure differential between the outer surface of fin 230 and the channel 260 pressure against the inner surface of fin 230 may equalize. Responsive to the pressure-equalizing, fin 230 may return to its initial shape.

As indicated, these modifications may be made to the invention in light of the foregoing description of illustrated embodiments of the invention and are to be included within the spirit and scope of the invention. Thus, while the invention has been described herein concerning particular embodiments thereof, a latitude of modification, various changes, and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", "one example" or "an example" means that a particular feature, structure, or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

In the description herein, numerous specific details are provided, such as examples of components and/or methods, to provide a thorough understanding of the embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the present technology has been described in detail for illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Benefits, other advantages, and solutions to problems have been described above about specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A downhole tool comprising:

a pump down ring positioned within a groove, the pump down ring including a fin and a notch, the notch is located downhole from the fin, the fin is configured to bend and apply pressure across the notch to secure the pump down ring within the groove when downward fluid is pumped past the downhole tool, wherein the downward fluid flow drives the fin downward across the notch.

2. The downhole tool of claim 1, wherein the groove extends into an outer diameter of the downhole tool.

3. The downhole tool of claim 2, wherein the groove and pump down ring are configured to size such that the pump down ring does not extend beyond the groove.

4. The downhole tool of claim 3, wherein a first width of the groove is shorter than a second width of the groove, the first width of the groove being located radially closer to a central axis of the downhole tool than the second width of the groove.

5. The downhole tool of claim 1, wherein the downhole tool is a cap of a bridge plug.

6. The downhole tool of claim 5, wherein the downhole tool is used to separate a first area from a second area after setting the bridge plug.

7. The downhole tool of claim 1, wherein the groove includes a base and a ledge, the base extending in parallel to a central axis of the downhole tool, and the ledge extends outward from the base away from the central axis of the downhole tool.

8. The downhole tool of claim 7, wherein a flange of the downhole tool is positioned adjacent to the ledge.

9. The downhole tool of claim 7, wherein the notch has a first width when run in hole and a second width when the downhole fluid flow drives the fin downward.

10. The downhole tool of claim 9, wherein the second width is smaller than the first width.

11. The downhole tool of claim 10, wherein the second width is substantially zero.

12. The downhole tool of claim 9, wherein when fluid is not flowing in an annulus outside of the fin the notch has the first width and when fluid is flowing in the annulus outside of the fin the notch has the second width.

13. The downhole tool of claim 9, wherein the fin includes a channel located on an inner surface of the fin.

14. The downhole tool of claim 1, wherein the pump down ring is configured to freely fit within the groove, and the pump down ring is configured to be retained within the groove based on the fin extending across the groove.

15. The downhole tool of claim 1, wherein the pump down ring includes a plurality of fins, wherein the fins are separated by slots.

16. The downhole tool of claim 15, wherein fluid can be communicated through the slots when proximal ends of the plurality of fins contact casing.

17. The downhole tool of claim 1, wherein the pump down ring is formed of an elastic material.

18. The downhole tool of claim 1, wherein the downhole tool is a frac plug with a bottom sub, the pump down ring being configured to be retrofitted and positioned within the groove without removing the bottom sub from a plug mandrel of the frac plug.

19. A downhole tool comprising:

a pump down ring positioned within a groove, the pump down ring including a fin and a notch, the notch is located downhole from the fin, the fin is configured to bend and apply pressure across the notch to secure the pump down ring within the groove when fluid is pumped past the downhole tool, wherein the downhole tool is a cap of a frac plug, and the cap is a single piece.

20. A method associated with a downhole tool comprising:

positioning a pump down ring within a groove, the pump down ring including a fin and a notch, the notch being located downhole from the fin, pumping fluid downhole past the downhole tool;

securing the pump down ring within the groove by bending the fin to apply pressure across the notch, the groove and pump down ring are configured to size such that the pump down ring does not extend beyond the groove.

21. The method of claim 20, further comprising:

machining the groove into an outer diameter of the downhole tool.

* * * * *